US009428367B2

(12) United States Patent
Zhu et al.

(10) Patent No.: US 9,428,367 B2
(45) Date of Patent: Aug. 30, 2016

(54) LONG-DISTANCE TRANSPORT SYSTEM FOR PEOPLE IN INCLINED LANE

(71) Applicant: CHINA UNIVERSITY OF MINING AND TECHNOLOGY, Jiangsu (CN)

(72) Inventors: Zhencai Zhu, Jiangsu (CN); Guohua Cao, Jiangsu (CN); Hong Lai, Jiangsu (CN); Jiancong Qin, Jinagsu (CN); Hongqiao Kang, Jiangsu (CN); Wei Li, Jiangsu (CN); Gongbo Zhou, Jiangsu (CN); Yuxing Peng, Jiangsu (CN); Yiping Ma, Jiangsu (CN); Jianrong Yang, Jiangsu (CN)

(73) Assignee: CHINA UNIVERSITY OF MINING AND TECHNOLOGY, Jiangsu (CN)

( * ) Notice: Subject to any disclaimer, the term of this patent is extended or adjusted under 35 U.S.C. 154(b) by 0 days.

(21) Appl. No.: 14/432,538

(22) PCT Filed: Jan. 27, 2014

(86) PCT No.: PCT/CN2014/071548

§ 371 (c)(1),
(2) Date: Mar. 31, 2015

(87) PCT Pub. No.: WO2014/146519

PCT Pub. Date: Sep. 25, 2014

(65) Prior Publication Data

US 2015/0375967 A1 Dec. 31, 2015

(30) Foreign Application Priority Data

Mar. 21, 2013 (CN) ..... 2013 1 0090679

(51) Int. Cl.
*B66B 23/00* (2006.01)
*B66B 23/02* (2006.01)
(Continued)

(52) U.S. Cl.
CPC ..... *B66B 23/02* (2013.01); *B66B 21/04* (2013.01); *B66B 23/00* (2013.01); *B66B 23/028* (2013.01); *B66B 23/12* (2013.01)

(58) Field of Classification Search
CPC ..... B66B 23/00; B66B 21/04
See application file for complete search history.

(56) References Cited

U.S. PATENT DOCUMENTS 3,707,220 A * 12/1972 Boltrek ..... B66B 23/02 198/330
4,232,776 A * 11/1980 Dean ..... B66B 23/26 198/322

(Continued)

FOREIGN PATENT DOCUMENTS

AT WO 2011/073708 * 12/2009 ..... B66B 23/00
CN 201367028 Y 12/2009

(Continued)

OTHER PUBLICATIONS

International Search Report issued from the State Intellectual Property Office of the P.R. China dated Apr. 16, 2014; International Application No. PCT/CN2014/071548.

*Primary Examiner* — Thomas Randazzo
(74) *Attorney, Agent, or Firm* — Bracewell LLP; Brad Y. Chin

(57) ABSTRACT

Embodiments of the invention provide a long-distance transport system for people in an inclined lane, in which the system includes a plurality of hydraulic driving units, a traction chain, a truss, supporting guide rails and retractable pedals. According to an embodiment of the invention, the truss is formed by a plurality of truss units sequentially connected end to end. Each truss unit is provided with the hydraulic driving unit. The traction chain and the supporting guide rails are all arranged in the length direction of the truss. The traction chain is driven by and connected with the plurality of the hydraulic driving units. The retractable pedals are arranged on the traction chain and are provided with supporting rollers rolling along the supporting guide rails.

7 Claims, 6 Drawing Sheets

(51) Int. Cl.
*B66B 23/12* (2006.01)
*B66B 21/04* (2006.01)

(56) References Cited

U.S. PATENT DOCUMENTS 4,832,169 A * 5/1989 Goto ..... B66B 23/00 198/326
5,178,254 A * 1/1993 Saito ..... B66B 29/00 198/323
6,374,981 B1 * 4/2002 Gschwendtner ..... B66B 23/00 198/321
6,427,823 B1 * 8/2002 Ishikawa ..... B66B 23/02 198/330
6,454,079 B1 * 9/2002 Teramoto ..... B65G 23/30 198/334
6,702,094 B2 * 3/2004 Ishikawa ..... B66B 23/02 198/326
6,814,215 B2 * 11/2004 Krampl ..... B66B 23/00 198/321
7,070,038 B2 * 7/2006 Haycock ..... B66B 23/024 198/321
2002/0175039 A1 * 11/2002 Fargo ..... B66B 23/00 198/321
2005/0108974 A1 * 5/2005 Lauch ..... B66B 23/00 52/633

FOREIGN PATENT DOCUMENTS

CN 102963801 A 3/2013
CN 103171961 A 6/2013
CN 203143899 U 8/2013
JP 2003212463 A 7/2003

* cited by examiner

LONG-DISTANCE TRANSPORT SYSTEM FOR PEOPLE IN INCLINED LANE

CROSS REFERENCE TO RELATED APPLICATION

This application claims the benefit of and priority to PCT/CN2014/071548 filed on Jan. 27, 2014, entitled (translation), "LONG-DISTANCE TRANSPORT SYSTEM FOR PEOPLE IN INCLINED LANE," which claims the benefit of and priority to Chinese Patent Application No. CN 201310090679.3 filed on Mar. 21, 2013, entitled (translation), "INCLINED DRIFT PERSONNEL LONG-DISTANCE TRANSPORTATION SYSTEM," both of which are hereby incorporated by reference in their entirety into this application.

BACKGROUND

1. Field of the Invention

Embodiments of the invention relate to a transportation facility in coal mines, in particular to an inclined drift long-distance transportation system for a person.

2. Description of the Related Art

Existing inclined drift transportation facilities for a person in coal mines mainly includes aerial cableway and a man car, etc. However, in recent years, accidents related to these transportation facilities take place frequently and have resulted in many casualties, and the safety of such facilities is worrisome, and thus the conventional art needs to be further improved and developed. Therefore, many coal mine enterprises are in urgent need for a safer and more comfortable transportation facility to substitute the existing ones to transport a person in the inclined drift of coal mines safely and efficiently.

SUMMARY

Embodiments of the invention provide a safer and more comfortable inclined drift long-distance transportation system to substitute existing inclined drift transportation facilities for a person in coal mines.

In accordance with an embodiment of the invention, there is provided an inclined drift long-distance transportation system for a person, in which the system includes a plurality of hydraulic drive units, a traction chain, a truss, a supporting guide rail, and a retractable pedal. According to an embodiment, the truss includes a plurality of truss units connected sequentially by a head-to-tail connection, and each truss unit includes a hydraulic drive unit thereon. According to an embodiment, the traction chain and the supporting guide rail are arranged along a length direction of the truss, and the plurality of hydraulic drive units are in transmission connection with the traction chain. According to an embodiment, the retractable pedal is arranged on the traction chain, and a plurality of supporting rollers configured to roll along the supporting guide rail are arranged on the retractable pedal.

According to an embodiment, each of the hydraulic drive unit includes an exterior driving frame, whereby the exterior driving frame includes hydraulic motors and supporting bases arranged separately thereon, the hydraulic motors are connected to a hydraulic pump station, a brake and a driving sprocket are arranged on an output shaft of each of the hydraulic motors, a rotating shaft is arranged on the supporting base, a driven sprocket is arranged on the rotating shaft, and the driving sprocket and driven sprocket are in transmission connection with each other via a transmission chain. According to an embodiment, the traction chain includes engaging teeth configured to engage the transmission chain, and the transmission chain and traction chain are in transmission connection with each other via the engaging teeth.

According to an embodiment, the hydraulic pump station includes an oil tank, a hydraulic pump, solenoid directional valves, a shunting motor, and one-way throttle valves. According to an embodiment, an oil supply chamber of the oil tank is connected to an oil inlet of the shunting motor via the hydraulic pump, an oil outlet of the shunting motor is connected to one oil inlet of the solenoid directional valve, a first reverse interface of the solenoid directional valve is connected to a obverse oil inlet of the hydraulic motor via the one-way throttle valve, a second reverse interface of the solenoid directional valve is connected to the reversed oil inlet of the hydraulic motor, and an oil outlet of the solenoid directional valve is connected to an oil return chamber of the oil tank.

According to an embodiment, a proportional flow valve, a flow meter, and a pressure gauge are arranged on the connecting pipeline between the oil outlet of the shunting motor and the oil inlet of the solenoid directional valve, and a shaft encoder is arranged on the output shaft of the hydraulic motor.

According to an embodiment, a sliding channel is arranged on the exterior driving frame, and the supporting base is arranged in the sliding channel in a slideable manner, and a tensioning spring is arranged between the supporting base and the exterior driving frame.

According to an embodiment, supporting devices configured to be adjusted upwards are arranged on the bottom of the plurality of truss units.

According to an embodiment, the traction chain includes several rack pieces connected sequentially by a head-to-tail connection, and adjacent rack pieces are connected to each other via a hinge.

Embodiments of the invention, as recited in the pending claims, provide non-obvious advantages over conventional systems. For example, (1) The truss in the transportation system, according to an embodiment of the invention, is formed by a plurality of truss units connected together to break down the entire transportation system into a plurality of smaller units, thus, transportation for the person with the transportation system in the inclined drift where the sectional dimension is small will be convenient;

(2) Each truss unit is provided with supporting devices that are configured to be adjusted upwards. Thus, multi-point support is formed on the bottom of the transportation system, and thereby the supporting safety of the transportation system is improved;

(3) Each truss unit is provided with a plurality of hydraulic drive units in it, and a traction chain is driven by the hydraulic drive units. Thus, the overall driving power of the transportation system is improved, the stress amplitude of the traction chain is reduced, and it is possible to implement long distance transportation or even super-long distance transportation;

(4) The traction chain is formed by a plurality of rack pieces hinged together, and all of the rack pieces have the same size. Thus, the manufacturing cost can be reduced greatly.

Various objects, advantages and features of the invention will become apparent from the following description of embodiments with reference to the accompanying drawings.

BRIEF DESCRIPTION OF DRAWINGS

These and other features, aspects, and advantages of the invention are better understood with regard to the following Detailed Description, appended Claims, and accompanying Figures. It is to be noted, however, that the Figures illustrate only various embodiments of the invention and are therefore not to be considered limiting of the invention's scope as it may include other effective embodiments as well.

Figure 1:
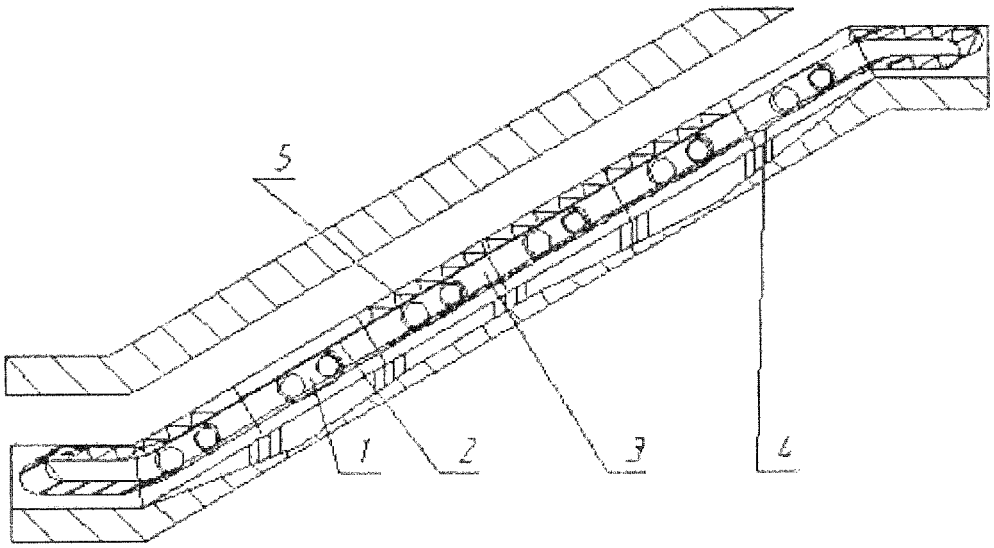
FIG. 1 is a schematic diagram of the layout in the inclined drift of the inclined drift long-distance transportation system for a person according to an embodiment of the invention.

Among the figures: 1—hydraulic drive unit; 2—traction chain; 3—truss; 4—supporting guide rail; 5—retractable pedal; 6—supporting roller; 7—engaging tooth; 8—sliding channel; 11—hydraulic pump station; 12—hydraulic motor; 13—brake; 14—transmission chain; 15—driving sprocket; 16—driven sprocket; 17—tensioning spring; 18—supporting base; 19—exterior driving frame; 20—oil tank; 21—hydraulic pump; 22—solenoid directional valve; 23—shunting motor; 24—proportional flow valve; 25—flow meter; 26—pressure gauge; 27—rack piece; 28—supporting device; 29—one-way throttle valve.

DETAILED DESCRIPTION

Advantages and features of the invention and methods of accomplishing the same will be apparent by referring to embodiments described below in detail in connection with the accompanying drawings. However, the invention is not limited to the embodiments disclosed below and may be implemented in various different forms. The embodiments are provided only for completing the disclosure of the invention and for fully representing the scope of the invention to those skilled in the art.

For simplicity and clarity of illustration, the drawing figures illustrate the general manner of construction, and descriptions and details of well-known features and techniques may be omitted to avoid unnecessarily obscuring the discussion of the described embodiments of the invention. Additionally, elements in the drawing figures are not necessarily drawn to scale. According to at least one embodiment, the dimensions of some of the elements in the figures may be exaggerated relative to other elements to help improve understanding of embodiments of the invention. Like reference numerals refer to like elements throughout the specification.

Figure 2:
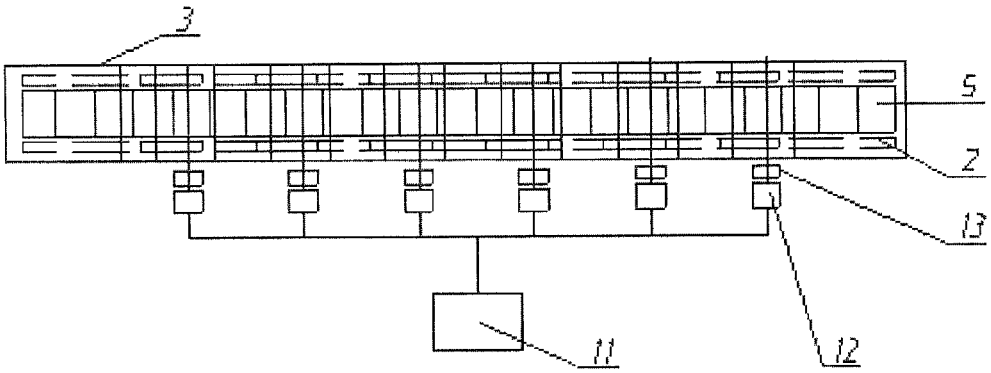
FIG. 2 is a top view of the inclined drift long-distance transportation system for the person according to an embodiment of the invention.

As shown in FIG. 1 and FIG. 2, the inclined drift long-distance transportation system for the person according to various embodiments of the invention includes a plurality of hydraulic drive units 1, a traction chain 2, a truss 3, a supporting guide rail 4, and a retractable pedal 5.

Figure 3:
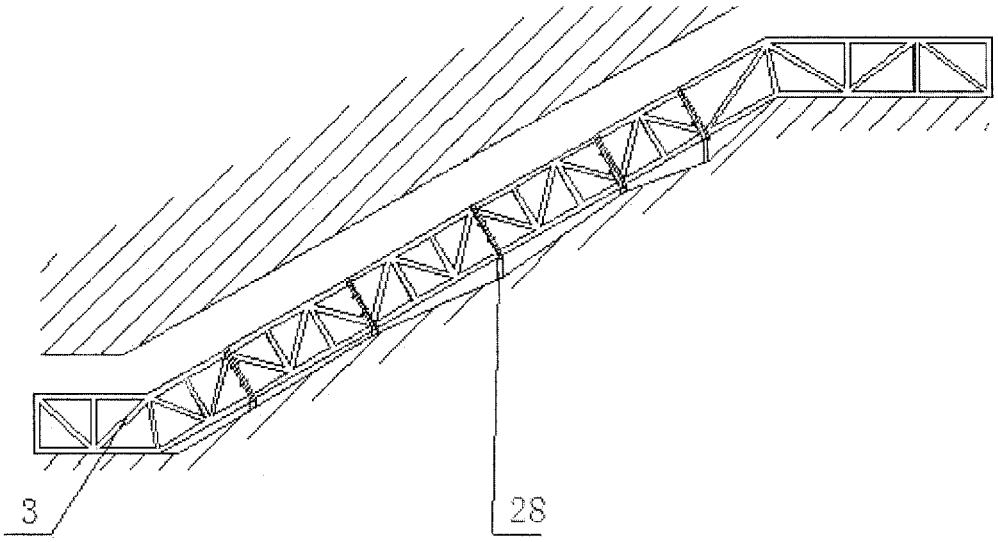
FIG. 3 is a schematic structural diagram of the truss of the inclined drift long-distance transportation system for the person according to an embodiment of the invention.

As shown in FIG. 3, the truss 3, according to an embodiment, includes six truss units connected sequentially by a head-to-tail connection, whereby adjacent truss units are fixed together by bolting, and supporting devices 28 that can be adjusted upwards are arranged on the bottom of the truss units.

Figure 4:
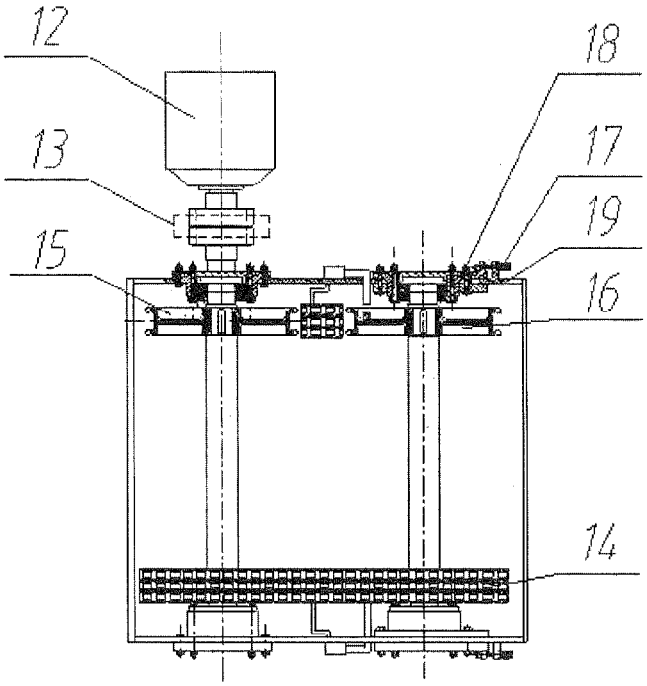
FIG. 4 is a top view of the hydraulic drive unit of the inclined drift long-distance transportation system for the person according to an embodiment of the invention.
Figure 5:
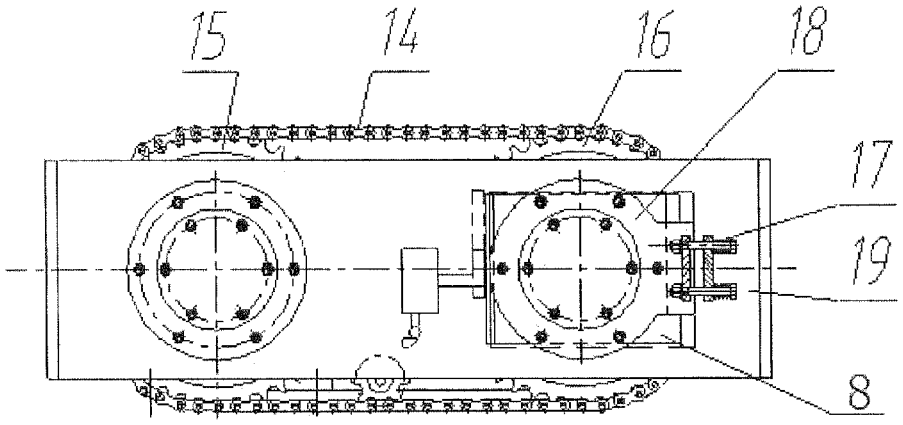
FIG. 5 is a side view of the hydraulic drive unit of the inclined drift long-distance transportation system for the person according to an embodiment of the invention.

As shown in FIG. 4 and FIG. 5, each truss unit is provided with a hydraulic drive unit 1 thereon, each of the hydraulic drive units 1 including an exterior driving frame 19. According to an embodiment, hydraulic motors 12 and supporting bases 18 are arranged separately on the exterior driving frame 19, and a hydraulic pump station 11 is connected to the hydraulic motors 12. A brake 13 and a driving sprocket 15 are arranged on an output shaft of each of the hydraulic motors 12, a rotating shaft is arranged on the supporting base 18, a driven sprocket 16 is arranged on the rotating shaft, and the driving sprocket 15 is in transmission connection with the driven sprocket 16 via a transmission chain 14. To keep the transmission chain 14 in tensioned state, a sliding channel 8 is arranged on the exterior driving frame 19, the supporting base 18 is arranged in the sliding channel 8 in a slideable manner, and a tensioning spring 17 is arranged between the supporting base 18 and the exterior driving frame 19, so that the transmission chain 14 is kept in tensioned state by the tensioning spring 17.

Figure 6:
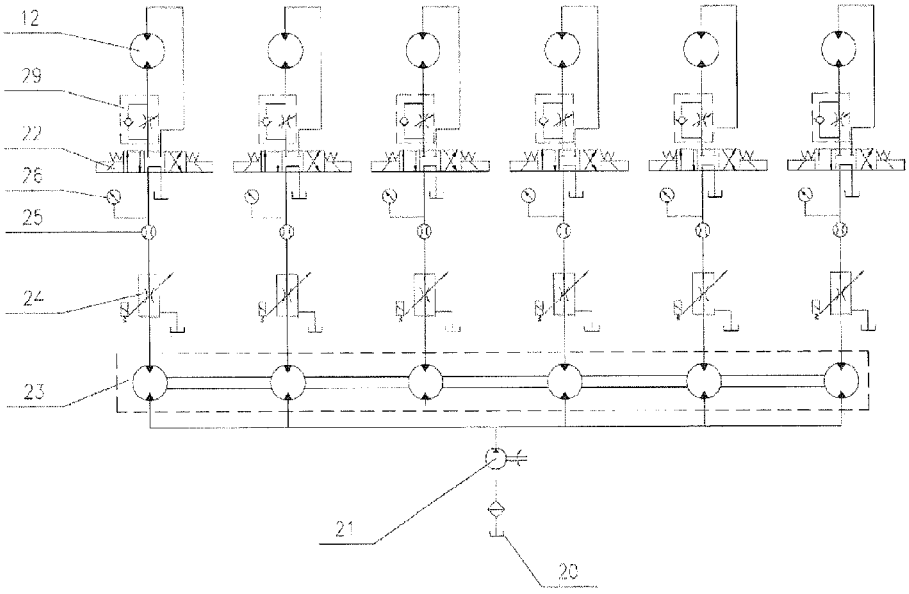
FIG. 6 is a schematic diagram of the principle of hydraulic pressure in the inclined drift long-distance transportation system for the person according to an embodiment of the invention.
Figure 7:
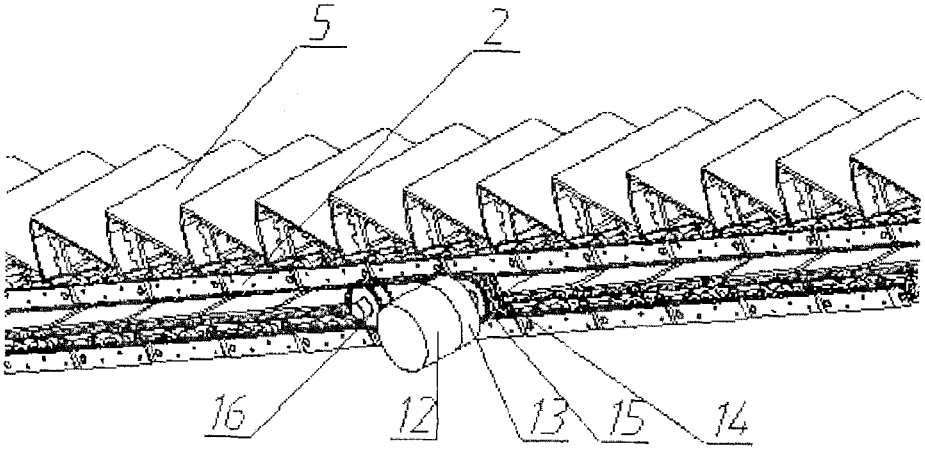
FIG. 7 is a schematic diagram of the transmission connection between the hydraulic drive unit and the traction chain in the inclined drift long-distance transportation system for the person according to an embodiment of the invention.
Figure 8:
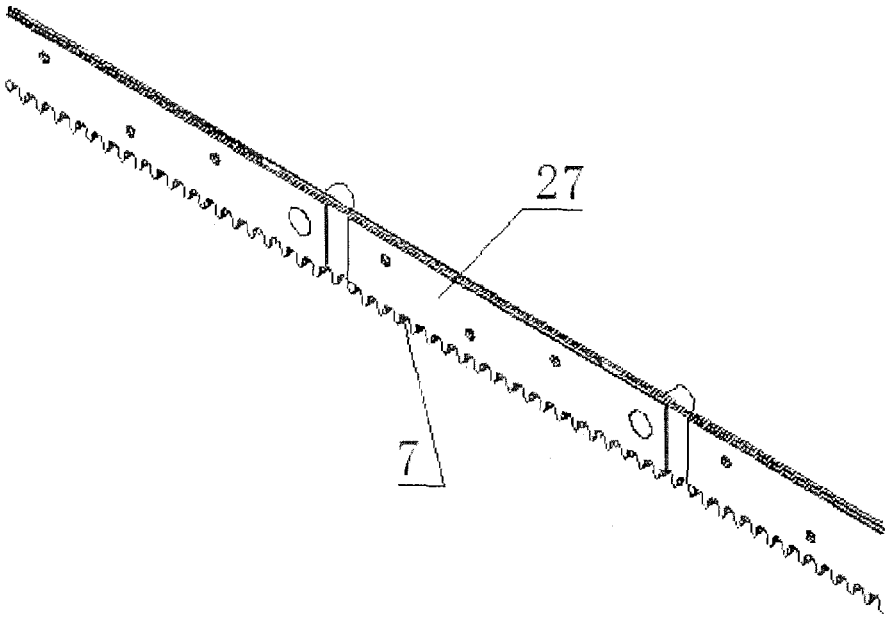
FIG. 8 is a schematic structural diagram of the traction chain of the inclined drift long-distance transportation system for the person according to an embodiment of the invention.

As shown in FIG. 6, the hydraulic pump station 11 includes an oil tank 20, a hydraulic pump 21, solenoid directional valves 22, a shunting motor 23, and one-way throttle valves 29. According to an embodiment of the invention, the shunting motor 23 has one oil inlet and six oil outlets, there are six solenoid directional valves 22 and six one-way throttle valves 29 respectively, and the six solenoid directional valves 22 and six one-way throttle valves 29 are in a one-to-one correspondence to the hydraulic motors 12 in the hydraulic drive unit 1. Each solenoid directional valve 22 has an oil inlet, two reverse interfaces, and an oil outlet. An oil supply chamber of the oil tank 20 is connected to the oil inlet of the shunting motor 23 via the hydraulic pump 21, each oil outlet of the shunting motor 23 is connected to the oil inlet of one solenoid directional valve 22, the first reverse interface of each solenoid directional valve 22 is connected to a obverse oil inlet of the hydraulic motor 12 via a one-way throttle valve 29, the second reverse interface of each solenoid directional valve 22 is connected to a reversed oil inlet of the hydraulic motor 12, and the oil outlet of each solenoid directional valve 22 is connected to an oil return chamber of the oil tank 20. To improve the synchronous output of the hydraulic drive unit 1, a proportional flow valve 24, a flow meter 25, and a pressure gauge 26 are arranged on the connecting pipeline between the oil outlet of the shunting motor 23 and the oil inlet of the solenoid directional valve 22, and a shaft encoder is arranged on the output shaft of the hydraulic motor 12. According to an embodiment of the invention, with the flow meter 25, pressure gauge 26, and shaft encoder, the hydraulic motor is monitored in real time, and the hydraulic motors 12 in the hydraulic drive units 1 are controlled to operate synchronously by regulating the flow through each proportional flow valve 24.

As shown in FIG. 1, FIG. 7, FIG. 8, and FIG. 11, both the traction chain 2 and the supporting guide rail 4 are arranged along the length direction of the truss 3. The traction chain 2 is formed by several rack pieces 27 connected sequentially a by head-to-tail connection, whereby adjacent rack pieces 27 are connected to each other via a hinge. According to an embodiment, each rack piece 27 includes engaging teeth 7 that engages with the transmission chain 14, and the traction chain 2 and the transmission chain 14 are in transmission connection with each other via the engaging teeth 7.

Figure 9:
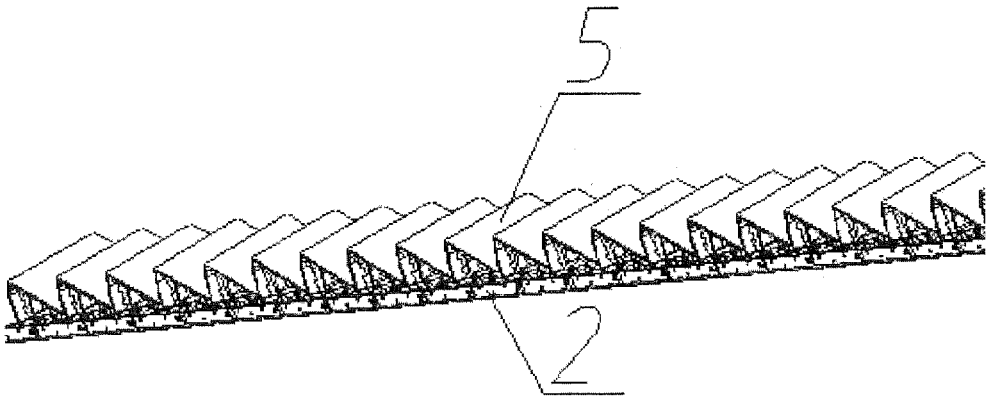
FIG. 9 is a schematic diagram of the connection between the retractable pedal and the traction chain in the inclined drift long-distance transportation system for the person according to an embodiment of the invention.
Figure 10:
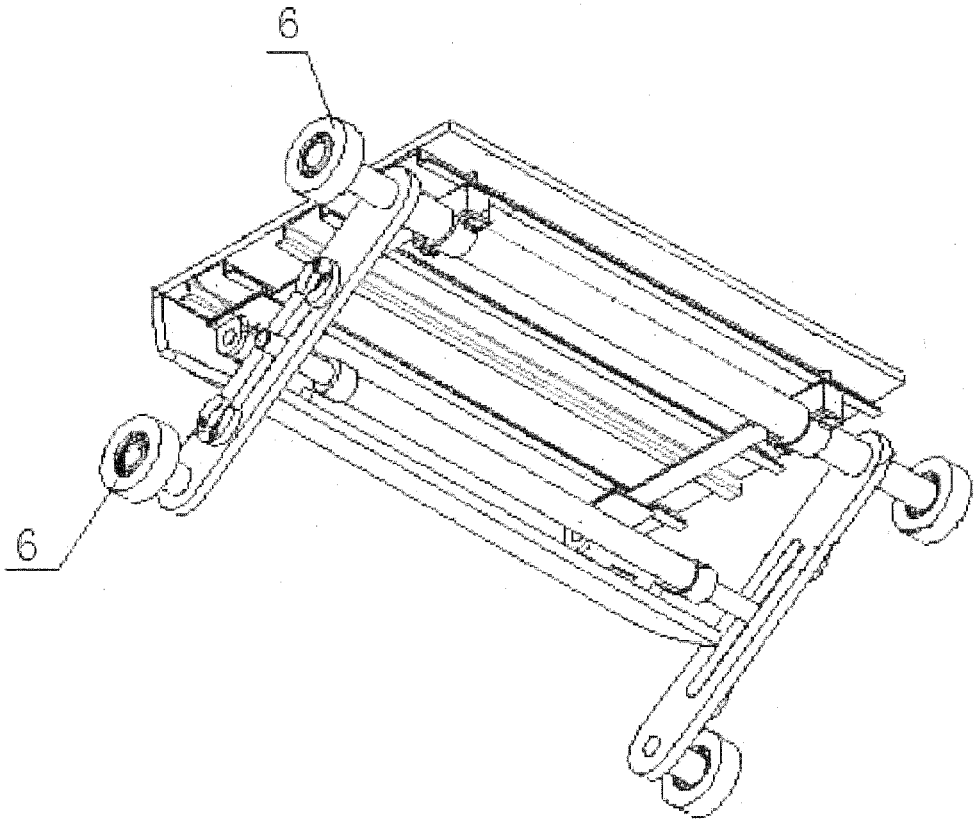
FIG. 10 is a schematic structural diagram of the retractable pedal of the inclined drift long-distance transportation system for the person according to an embodiment of the invention.
Figure 11:
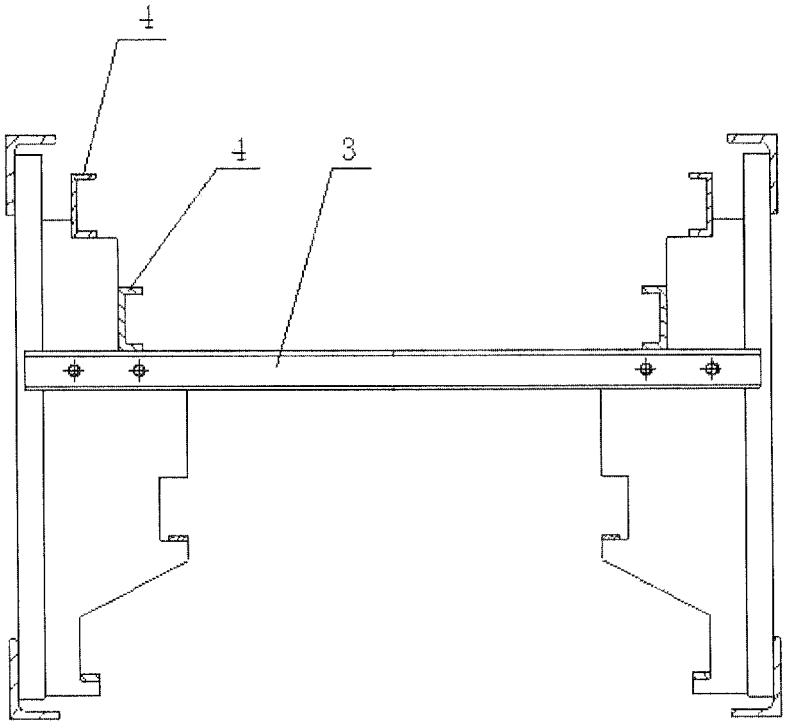
FIG. 11 is a sectional view of the supporting guide rail of, the inclined drift long-distance transportation system for the person according to an embodiment of the invention.

As shown in FIGS. 9-11, the retractable pedal 5, according to an embodiment of the invention, is arranged next to each other or at a separate space on the traction chain 2, and the retractable pedal 5 is connected with the traction chain 2 via a hinge. According to an embodiment, supporting rollers 6 capable of rolling along the supporting guide rail 4 are arranged on the retractable pedal 5.

According to at least one embodiment, the inclined drift long-distance transportation system for the person can be implemented in bidirectional transportation.

According to an embodiment, the solenoid directional valve 22 is controlled so that the oil inlet of the solenoid directional valve 22 communicates with the first reverse interface while the second reverse interface communicates with the oil outlet. According to an embodiment, the hydraulic pump 21 sucks up hydraulic oil from the oil supply chamber of the oil tank 20, and the hydraulic oil is shunted by the shunting motor 23 so that the flow is evenly distributed to each hydraulic drive unit 1. Subsequently, the hydraulic oil passes through the proportional flow valve 24, flow meter 25, solenoid directional valve 22, and one-way throttle valve 29, and flows into the hydraulic motor 12 through the obverse oil inlet, and drives the hydraulic motor 12 to rotate in the obverse direction. Subsequently, the hydraulic oil is discharged from the hydraulic motor 12 through the reversed oil inlet, passes through the solenoid directional valve 22, and flows into the oil return chamber of the oil tank 20. As the hydraulic motor 12 rotates in the obverse direction, it drives the transmission chain 14 to circulate in the obverse direction, and the transmission chain 14 drives the traction chain 2 and the retractable pedal 5 to move upwards together along the supporting guide rail 4, thereby transporting persons upwards in the inclined drift.

According to another embodiment, the solenoid directional valve 22 is controlled so that the oil inlet of the solenoid directional valve 22 communicates with the second reverse interface while the first reverse interface communicates with the oil outlet. According to an embodiment, the hydraulic pump 21 sucks up hydraulic oil from the oil supply chamber of the oil tank 20, and the hydraulic oil is shunted by the shunting motor 23 so that the flow is evenly distributed to each hydraulic drive unit 1. Subsequently, the hydraulic oil passes through the proportional flow valve 24, flow meter 25, solenoid directional valve 22, and one-way throttle valve 29, and flows into the hydraulic motor 12 through the reversed oil inlet, and drives the hydraulic motor 12 to rotate in the reversed direction; then, the hydraulic oil is discharged from the hydraulic motor 12 through the obverse oil inlet, passes through the one-way throttle valve 29 and solenoid directional valve 22, and flows into the oil return chamber of the oil tank 20. As the hydraulic motor 12 rotates in the reversed direction, it drives the transmission chain 14 to circulate in the reversed direction, and the transmission chain 14 drives the traction chain 2 and the retractable pedal 5 to move downwards together along the supporting guide rail 4, thereby transporting persons downwards in the inclined drift.

According to an embodiment, the solenoid directional valve 22 is controlled so that the oil inlet of the solenoid directional valve 22 communicates with its oil outlet, the hydraulic pump 21 sucks up hydraulic oil from the oil supply chamber of the oil tank 20, and the hydraulic oil is shunted by the shunting motor 23 and evenly distributed to each hydraulic drive unit 1. Subsequently, the hydraulic oil passes through the proportional flow valve 24, flow meter 25, and solenoid directional valve 22, and flows into the oil return chamber of the oil tank 20. In this case, the hydraulic oil doesn't flow through the hydraulic motor 12, and the hydraulic motor 12 stops, i.e., the transportation for the person in the inclined drift stops.

Terms used herein are provided to explain embodiments, not limiting the invention. Throughout this specification, the singular form includes the plural form unless the context clearly indicates otherwise. When terms "comprises" and/or "comprising" used herein do not preclude existence and addition of another component, step, operation and/or device, in addition to the above-mentioned component, step, operation and/or device.

Embodiments of the invention may suitably comprise, consist or consist essentially of the elements disclosed and may be practiced in the absence of an element not disclosed. According to at least one embodiment, it can be recognized by those skilled in the art that certain steps can be combined into a single step.

The terms and words used in the specification and claims should not be interpreted as being limited to typical meanings or dictionary definitions, but should be interpreted as having meanings and concepts relevant to the technical scope of the invention based on the rule according to which an inventor can appropriately define the concept of the term to describe the best method he or she knows for carrying out the invention.

The terms "first," "second," "third," "fourth," and the like in the description and in the claims, if any, are used for distinguishing between similar elements and not necessarily for describing a particular sequential or chronological order. It is to be understood that the terms so used are interchangeable under appropriate circumstances such that the embodiments of the invention described herein are, for example, capable of operation in sequences other than those illustrated or otherwise described herein. Similarly, if a method is described herein as comprising a series of steps, the order of such steps as presented herein is not necessarily the only order in which such steps may be performed, and certain of the stated steps may possibly be omitted and/or certain other steps not described herein may possibly be added to the method.

The singular forms "a," "an," and "the" include plural referents, unless the context clearly dictates otherwise.

As used herein and in the appended claims, the words "comprise," "has," and "include" and all grammatical variations thereof are each intended to have an open, non-limiting meaning that does not exclude additional elements or steps.

As used herein, it will be understood that unless a term such as 'directly' is not used in a connection, coupling, or disposition relationship between one component and another component, one component may be 'directly connected to', 'directly coupled to' or 'directly disposed to' another element or be connected to, coupled to, or disposed to another element, having the other element intervening therebetween.

As used herein, the terms "left," "right," "front," "back," "top," "bottom," "over," "under," and the like in the description and in the claims, if any, are used for descriptive purposes and not necessarily for describing permanent relative positions. It is to be understood that the terms so used are interchangeable under appropriate circumstances such that the embodiments of the invention described herein are, for example, capable of operation in other orientations than those illustrated or otherwise described herein. The term "coupled," as used herein, is defined as directly or indirectly connected in an electrical or non-electrical manner. Objects described herein as being "adjacent to" each other may be in physical contact with each other, in close proximity to each other, or in the same general region or area as each other, as appropriate for the context in which the phrase is used. Occurrences of the phrase "according to an embodiment" herein do not necessarily all refer to the same embodiment.

Ranges may be expressed herein as from about one particular value, and/or to about another particular value. When such a range is expressed, it is to be understood that another embodiment is from the one particular value and/or to the other particular value, along with all combinations within said range.

Although the invention has been described in detail, it should be understood that various changes, substitutions, and alterations can be made hereupon without departing from the principle and scope of the invention. Accordingly, the scope of the invention should be determined by the following claims and their appropriate legal equivalents.

The invention claimed is:

1. An inclined drift long-distance transportation system for a person, the system comprising:

a plurality of hydraulic drive units;

a traction chain;

a truss;

a supporting guide rail; and a retractable pedal, wherein the truss comprises a plurality of truss units connected sequentially by a head-to-tail connection, and each truss unit comprises a hydraulic drive unit thereon, wherein the traction chain and the supporting guide rail are arranged along a length direction of the truss, and the plurality of hydraulic drive units are in transmission connection with the traction chain wherein the retractable pedal is arranged on the traction chain, the retractable pedal comprising a plurality of supporting rollers configured to roll along the supporting guide rail.

2. The inclined drift long-distance transportation system for the person according to claim 1, wherein each of the hydraulic drive unit comprises an exterior driving frame the exterior driving frame comprising hydraulic motors and supporting bases arranged separately thereon, wherein the hydraulic motors are is connected to a hydraulic pump station, wherein a brake and a driving sprocket are arranged on an output shaft of each of the hydraulic motors, wherein a rotating shaft is arranged on the supporting base, wherein a driven sprocket is arranged on the rotating shaft, and wherein the driving sprocket and the driven sprocket are in transmission connection with each other through a transmission chain, wherein the traction chain comprises engaging teeth configured to engage with the transmission chain, and wherein the transmission chain and traction the chain are in transmission connection with each other via the engaging teeth.

3. The inclined drift long-distance transportation system for the person according to claim 2, wherein the hydraulic pump station comprises an oil tank, a hydraulic pump, solenoid directional valves, a shunting motor, and one-way throttle valves, wherein an oil supply chamber of the oil tank is connected to an oil inlet of the shunting motor via the hydraulic pump, an oil outlet of the shunting motor is connected to the oil inlet of one solenoid directional valve, wherein a first reverse interface of the solenoid directional valve is connected to an obverse oil inlet of the hydraulic motor via the one-way throttle valve, wherein a second reverse interface of the solenoid directional valve is connected to a reversed oil inlet of the hydraulic motor, and wherein an oil outlet of the solenoid directional valve is connected to an oil return chamber of the oil tank.

4. The inclined drift long-distance transportation system for the person according to claim 3, wherein a proportional flow valve a flow meter, and a pressure gauge are arranged on the connecting pipeline between the oil outlet of the shunting motor and the oil inlet of the solenoid directional valve; the system further comprising a shaft encoder arranged on the output shaft of the hydraulic motor.

5. The inclined drift long-distance transportation system for the person according to claim 2, wherein a sliding channel is arranged on the exterior driving frame, and wherein the supporting base is arranged in the sliding channel in a slideable manner, and wherein a tensioning spring is provided between the supporting base and the exterior driving frame.

6. The inclined drift long-distance transportation system for person according to claim 1, wherein supporting devices configured to be adjusted upwards are arranged on the bottom of the plurality of truss units.

7. The inclined drift long-distance transportation system for the person according to claim 1, wherein the traction chain comprises several rack pieces connected sequentially by a head-to-tail connection, and wherein adjacent rack pieces are connected together via a hinge.

* * * * *